United States Patent [19]

Clark et al.

[11] 4,317,521

[45] Mar. 2, 1982

[54] APPARATUS AND METHOD FOR SORTING ARTICLES

[75] Inventors: Reginald H. Clark; John D. MacArthur; Michael Sayer, all of Kingston; William D. Wilder, Ottawa, all of Canada

[73] Assignee: Resource Recovery Limited, Ottawa, Canada

[21] Appl. No.: 178,094

[22] Filed: Aug. 14, 1980

Related U.S. Application Data

[63] Continuation of Ser. No. 940,256, Sep. 7, 1978, abandoned.

[30] Foreign Application Priority Data

Sep. 9, 1977 [CA] Canada ..... 286567

[51] Int. Cl.[3] ..... B07C 5/34

[52] U.S. Cl. ..... 209/558; 209/586; 209/589; 209/698; 198/365; 250/277 R

[58] Field of Search ..... 209/555, 558, 563–566, 209/576, 577, 586, 588, 606, 656, 658, 698, 589; 198/365, 796; 250/272, 277 R, 358 R, 359

[56] References Cited

U.S. PATENT DOCUMENTS

| | | | |
|---|---|---|---|
| 2,925,497 | 2/1960 | Bessen | 250/272 |
| 3,286,811 | 11/1966 | McWilliams | 198/365 |
| 3,747,755 | 7/1973 | Senturia et al. | 209/698 X |
| 3,750,879 | 8/1973 | Luckett et al. | 198/365 X |
| 4,031,998 | 6/1977 | Suzuki et al. | 198/365 |

*Primary Examiner*—Joseph J. Rolla
*Attorney, Agent, or Firm*—Alfred E. Miller

[57] ABSTRACT

Apparatus and method for sorting scrap metal pieces dependent on the type of metal therein. The apparatus includes a conveyor and a feeding arrangement to feed the scrap metal pieces on to the conveyor, together with an X-ray fluorescence detector to examine each metal piece and determine the type of metal as a result of the characteristic X-rays emitted. A respective control signal is utilized to move pegs on the conveyor so as to permit the respective metal piece to exit from the conveyor along a respective path and to enter a bin for that particular type of metal. In this way scrap metal pieces of different metal are collected in different bins for subsequent processing.

19 Claims, 11 Drawing Figures

PANEL JACK
TEST CIRCUIT FOR SOLENOIDS
2Hz
3V
3-2B
1K
RS55N
+5V
100K
56K
1μs
.01μf
GND
GND 8
SO 6 7
SO 5 6
SO 4 5
SO 3 4
SO 2 3
SO 1 2
SO Ø 1
JONES PLUG TO POWER STORAGE

8-IA
8-IJ
8-IH
8-IF
8-IE
8-ID
8-IC
8-IB
BLOCK 2
3-IV
3-IT
3-IS
3-IR
3-IP
3-IN
3-IM
2N3904
82Ω
2N39
1K
3-IB
SOLENOID ENABLE
+3V
3-IC
METAL DETECTOR ON OFF
7410 (E2)
7400 (A1)
7400 (A2)
TEST JACKS
7473
CLR
(D3)
74121
(D1)
(D2)
0.01μf
7-IU
7-IT
N.O
METAL DETECTOR RELAY
3-ID
3-IE
3-IF
3-IH
3-IJ
3-IK
3-IL
DO 6
DO 5
DO 4
DO 3
DO 2
DO 1
DO Ø
COMPUTER REGISTER
PANEL PLUG TO COMPUTER
BLOCK 2

APPARATUS AND METHOD FOR SORTING ARTICLES

This is a continuation of application Ser. No. 940,256, filed Sept. 7, 1978, now abandoned.

BACKGROUND OF THE INVENTION

This invention relates to an apparatus and method for sorting articles.

Embodiments of the invention are particularly concerned with sorting mixed metal pieces dependent on the type of metal.

Methods have previously been proposed whereby articles have been sorted manually as they pregressed along a conveyor belt. Once identified, such articles would be manually removed from the conveyor belt and deposited in appropriately identified receptacles. A method and apparatus is known for the separation of uranium bearing rock and this consists of a vibratory feeding mechanism together with a translucent conveyor belt. A light source device is provided to measure the rock size together with a radioactive counter which measures the radiation rate from each rock. From the measurements, a product of the rock size and radiation rate is computed electronically and a signal is produced to cause actuation of air jets which separate the rocks into two categories at the end of the conveyor belt. Attempts have been made to utilize this apparatus for sorting other items, such as pieces of scrap metal, into different categories but such attempts were not successful.

Apparatus is known for sorting mixed metals using differential melting techniques. It is believed that this process is relatively inefficient and consumes large amounts of energy.

As it will be appreciated, apparatus for sorting scrap metal would be particularly attractive from a commercial point of view having regard to the amount of scrap metal which is presently located in different scrap metal yards as, for example, an end product of the automobile industry.

From one aspect it is an object of the present invention to provide apparatus for sorting objects which is applicable to the sorting of scrap metal and in which the above-mentioned disadvantages are obviated or substantially reduced.

SUMMARY OF THE INVENTION

According to this aspect, there is provided conveyor apparatus for conveying a plurality of articles along a conveyor in the direction of the conveyor and causing different articles to leave the conveyor at different exit stations comprising a conveyor having a plurality of keys extending transversely across the conveyor and each capable of movement from a supporting position to a non-supporting position at a selected exit station whereby a respective article is caused to leave the conveyor at said selected exit station.

More specifically there is provided conveyor apparatus for sorting scrap metal pieces dependent on the type of metal therein including a conveyor, feeding means to feed the scrap metal pieces on to said conveyor, detector means located adjacent said conveyor to examine said scrap metal pieces and determine the type of metal therein and to provide a corresponding identifying signal, control means for utilising each respective corresponding identifying signal to select one of a plurality of paths whereby each scrap metal piece is fed along a selected path in dependence on the type of metal determined therein by said detector means.

From another aspect, it is an object of the present invention to provide a method of sorting objects which is particularly applicable to the sorting of scrap metal and in which the above-mentioned disadvantages are obviated or substantially reduced.

According to this aspect there is provided a method of sorting scrap metal piece dependent on the type of metal therein including the steps of feeding the scrap metal pieces on to a conveyor, radiating each scrap metal piece with radiation from a radioactive source whereby it emits characteristic X-rays dependent on the type of metal therein, detecting said characteristic X-rays and producing a corresponding identifying signal corresponding to said type of metal, utilising each corresponding identifying signal in control means to select one of a plurality of paths to feed each piece of scrap metal along a selected path in dependence on the type of metal determined therein.

According to yet another aspect there is provided apparatus for sorting objects comprising a conveyor constructed of members extending transversely thereacross with a gap between each pair of said member, and a reference unit positioned at a fixed location in relation to the conveyor whereby the position of objects travelling along the conveyor can be measured therefrom.

DESCRIPTION OF THE DRAWINGS

Embodiments of the present invention will now be described, by way of example, with reference to the accompanying drawings in which.

DESCRIPTION OF THE PREFERRED EMBODIMENTS

Figure 1:
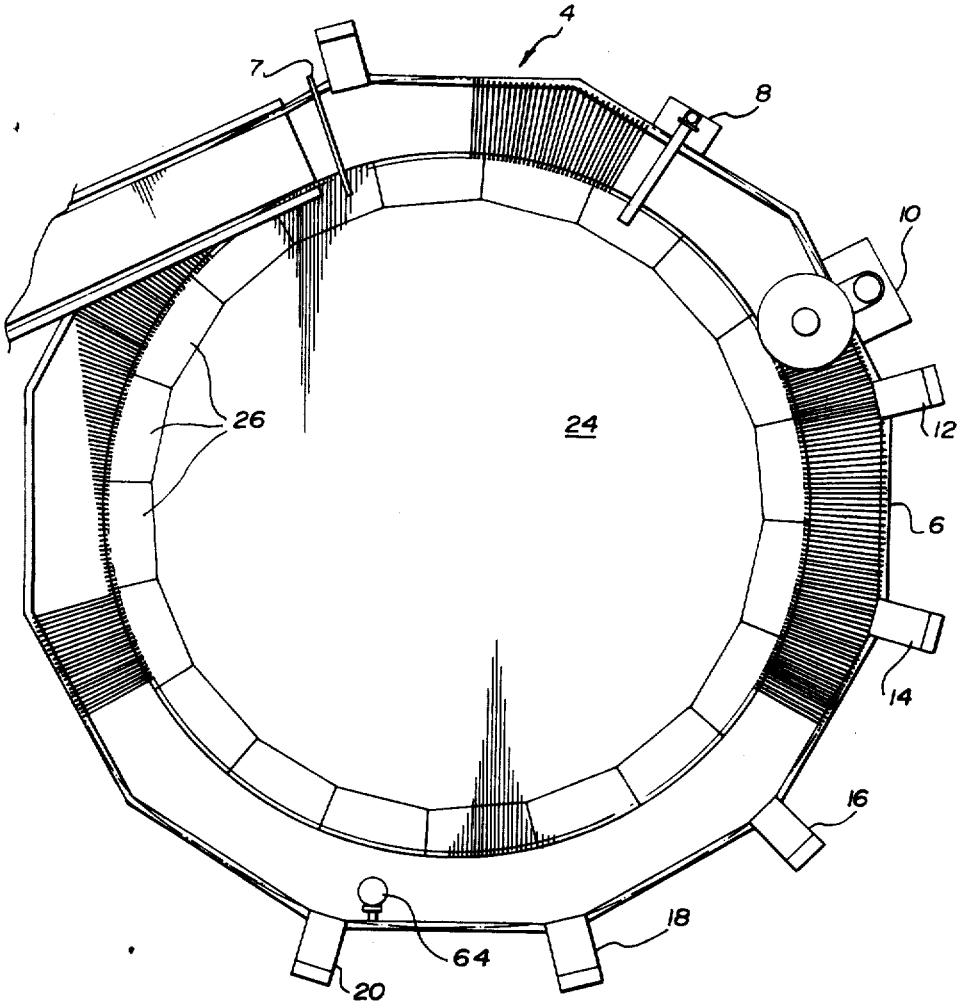
FIG. 1 is a diagrammatic representation, in plan view, of apparatus for sorting scrap metal.
Figure 2:
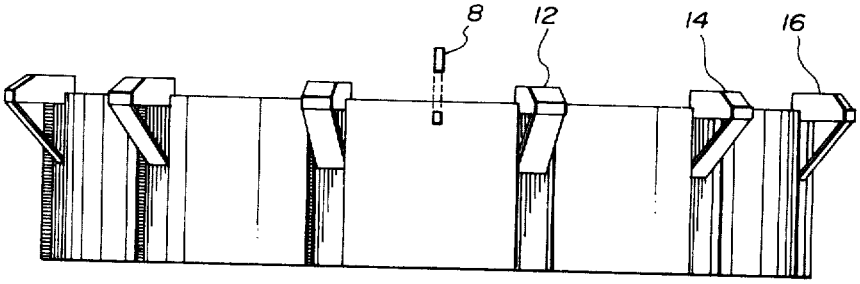
FIG. 2 is a side view of the apparatus illustrated in FIG. 1.

Referring to FIGS. 1 and 2, there is diagrammatically illustrated apparatus for sorting scrap metal. The mixed pieces of scrap metal travel along a conveyor belt system 2 onto a sorter conveyor system 4 arranged in a circular manner as illustrated in FIG. 1. The circular or carousel conveyor 4 comprises a plurality of individual members or keys adapted to support the pieces of scrap metal fed thereon from the conveyor belt 2. In use, the carousel conveyor 4 in FIG. 1 moves in a clockwise direction. Thus, each piece of scrap metal is supported by one or more members 6, dependent on its size, and passes, first of all through an overhead detection unit 7 and then through the vertical light beams emanating from the light head, unit 8, where the size of the piece may be determined. Information signals as to the size of the piece and its presence on the carousel conveyor are fed to the computer unit as described below.

After passing the light head, unit 8, the respective piece of metal material continues along the carousel conveyor and under the X-ray fluorescence unit 10. This unit determines the elements present in the scrap metal and passes this information to the computer unit which then analyzes all information signals received and produces resultant output control signals. These resultant output control signals are dependent on the type of elements determined to exist in the piece of scrap metal and also on the size of the piece of metal. The computer's output signals are fed to a selected one of a plurality of control stations, dependent on the type of metal. The control stations are identified in FIG. 1 as stations 12,14,16,18 and 20. Each station is adapted to receive scrap metal of a particular type, for example, iron, brass, zinc or aluminum. At the station where aluminum is deposited a metal detector is provided beneath the members 6. Only if the piece of scrap material is determined to be metallic, is the piece deposited here. Consequently, non-metallic pieces continue along the carousel conveyor to the discard bin.

The construction of the carousel conveyor 4 will now be considered in greater detail, particularly having regard to the construction of the individual members or keys 6. Referring to FIG. 1, the carousel conveyor consists of a circular wheel, or table, 24 carrying a plurality of metal plates, such as 26, rigidly mounted around the periphery of the table 24. Each metal plate 26 supports a group of nineteen individual members in a manner which will be described in greater detail with reference to FIG. 3.

Figure 3:
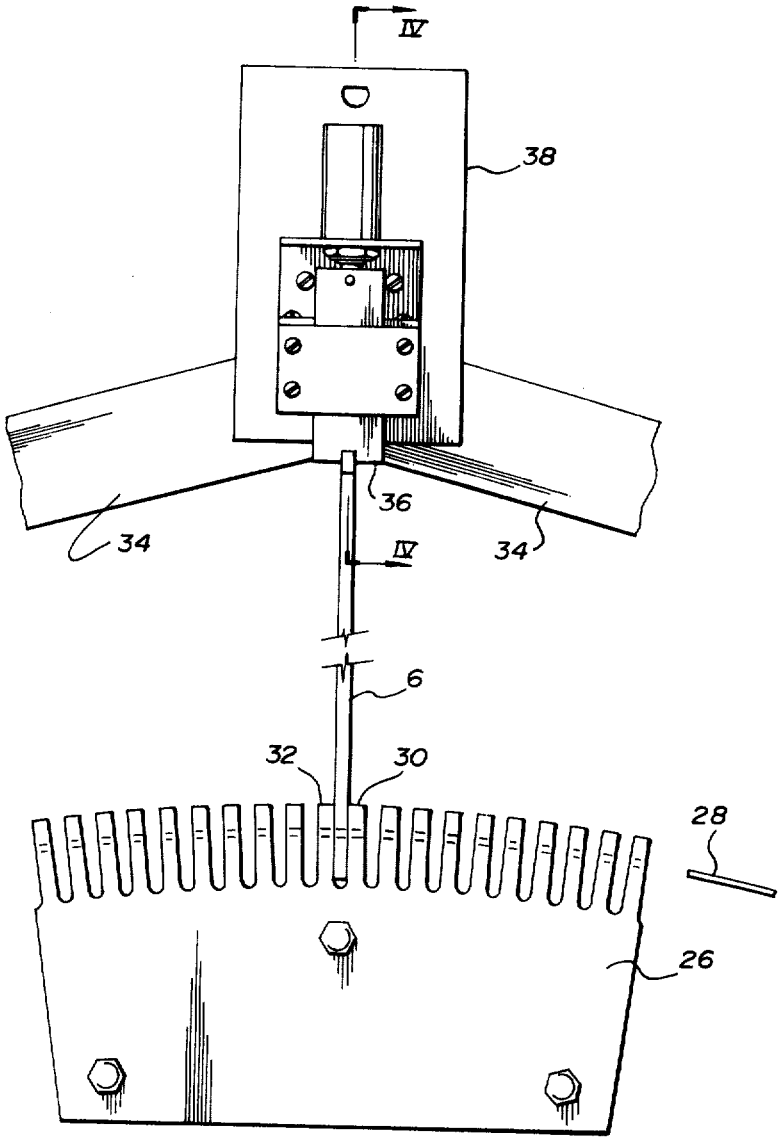
FIG. 3 is a plan view on an enlarged scale of part of the apparatus shown in FIG. 1 so as to illustrate details thereof.

Each individual member 6 consists of a plastic key which is ten inches long and a quarter-inch square cross section. Each key is supported at its inner end on the respective metal plates 26 in a pivotal manner by means of a metal rod 28. One such rod is shown in FIG. 3 in a remote location so as to indicate how it would be inserted through an aperture in the respective member 6 and aligned apertures in finger portions 30 and 32 on either side of the respective member 6. Thus, each key is supported at its inner end so that it can rotate about the respective metal rod 28.

The other end of the key portion 6 is normally supported by a smooth metal plate 34 which extends around the outer periphery of the carousel conveyor 4. Thus, the outer end of each member 6 can slide over the smooth metal plate 34 during normal rotation of the carousel.

Figure 4:
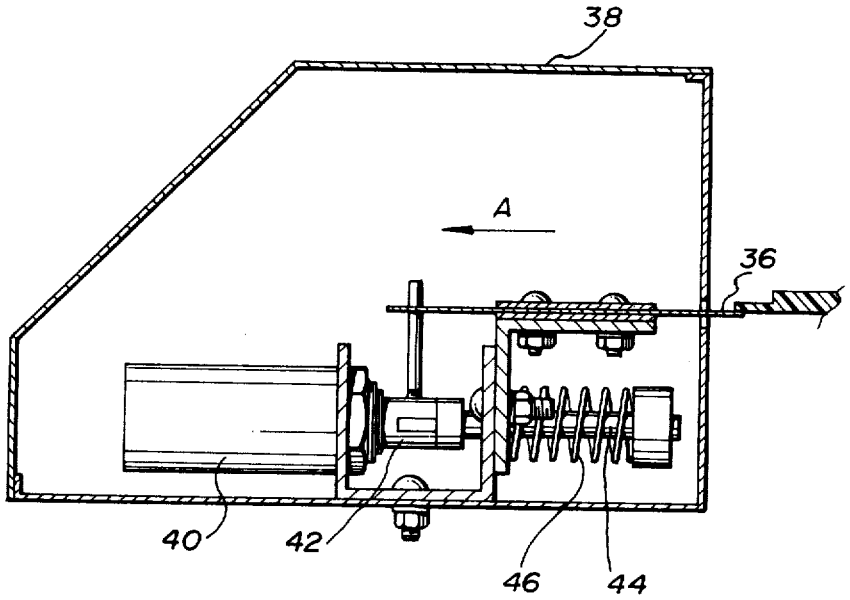
FIG. 4 is a cross-sectional view of part of FIG. 3 taken on the line IV—IV.

At the various control stations 12 through 22, the continuity of the smooth metal plate 34 is interrupted. The interruption is filled by a slidable metal plate 36 (FIG. 3) which can be retracted under control of the solenoid device 38 so as to cause the respective member of key 6 to rotate about its metal rod or pin 28. Referring particulary to FIG. 4, it will be seen that the solenoid device 38 comprises a solenoid coil unit 40 having a movable armature 42. Attached thereto is a rod 44 which supports the slidable metal plate 36 in the manner illustrated. Energization of the coil unit 40 causes the armature 42 to move in the direction A pulling the metal plate 36 with it and allowing the respective key 6 to rotate as described above. However, as soon as current is removed from the coil unit 40, the spring memory is effective to cause plate 36 to return to its original position where it supports the said members 6 as they move with the carousel conveyor. A slidable metal plate 36 and associated solenoid device 38 is provided at each of the control stations 12 through 22. The operation of the respective solenoid devices is controlled by a computer unit, to be described, in dependence on the signals produced by the light head unit 8 and the X-ray fluorescence unit 10.

Figure 5:
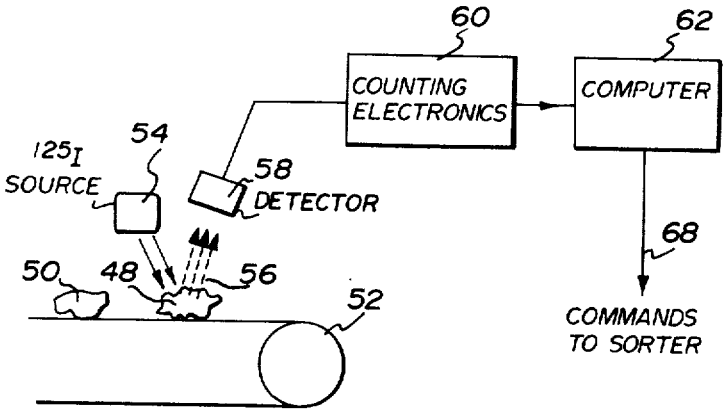
FIG. 5 is a diagrammatic representation to show the use of an X-ray fluourescence unit.

In FIG. 5, the X-ray fluorescence system is diagrammatically illustrated in a little greater detail so as to provide a greater understanding of its operation. For convenience, pieces of scrap metal 48 and 50 are shown as moving along a standard conveyor 52. The piece 48 has reached the examination position and fluorescence is produced by an $^{125}I$ source 54 irradiating the sample of scrap metal 48. Specific X-rays 56 are produced and are detected with a Si (Li) detector unit 58 manufactured by Kevex Corp. As will be understood, the charge produced in the silicon wafer thereof is fed to a pre-amplifier and then is amplified by the Kevex Corp. pulse processor within unit 60. An analog electrical signal is produced and this is digitized by a Northern scientific analog to digital convertor within unit 60. The resultant digital information is then fed to a computer unit 62 through a Tracor Northern 1313 Interface within unit 60.

The computer unit 62 then analyzes the information received in order to produce an output signal on line 68 whereby control of the selected one of the control stations 12 through 22 can be effected. In this way, the type of metal in a piece of scrap metal can be determined and, at the corresponding respective control station, the keys 6 can be caused to rotate whereby the piece of metal drops at that control station into a chute and, for example, a receiving bin for that particular type of metal. At the control station 20 where aluminum is to be deposited, a metal detector unit 64 is located below the conveyor as illustrated in FIG. 1. This unit overrides the control signal to this station if the material is non-metallic so as to prevent the dropping of the members 6. In this way, all the scrap metal of a particular type can be collected in a particular bin for future processing.

As will be appreciated, the number of keys 6 which are caused to drop, i.e. rotate, by retraction of the respective slidable metal plate 36 (FIG. 3) is dependent on the size of the piece of scrap metal. This is determined by the light head unit 8 of FIG. 1 which comprises two horizontal metal bars, one of which is placed below the position of the keys 6. This metal bar incorporates sixteen infra-red omitting light sources (type TIL 32) and optical lenses to focus the light whilst the other metal bar is placed above the keys 6 and incorporates sixteen solid state infra-red detectors (type TIL 63). The sixteen detectors and the sixteen emitters are recessed in the respective metal bar so that a light beam from a given emitter is received by only the corresponding detector. Fifteen of the light beams are utilized in the detection of objects on the conveyor, e.g. pieces of scrap metal, whilst one of the light beams, the one closest to the perimeter of the wheel, is utilized to provide a pulse to interrupt the computer and to provide a pulse to the logic circuits used for test purposes. For test purposes, the logic circuits are designed to prevent any action being taken merely because successive keys pass through the light beam. The logic circuits are designed to respond to the presence of pieces of scrap metal. It will be apparent that the circuits to provide the interrupt signal and perform the above logic can readily be suitably designed.

Figure 6:
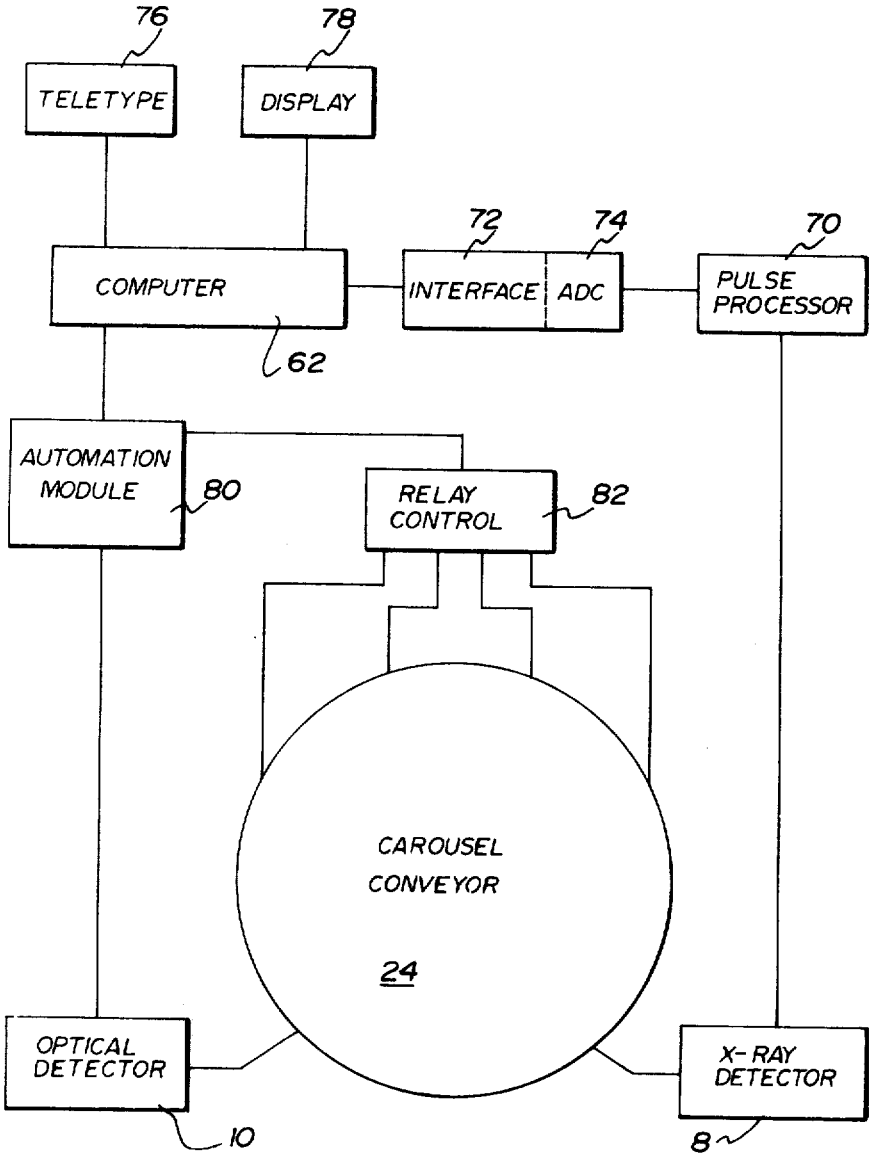
FIG. 6 is a block schematic representation of the electronic control circuits for the apparatus illustrated in FIG. 1.
Figure 7:
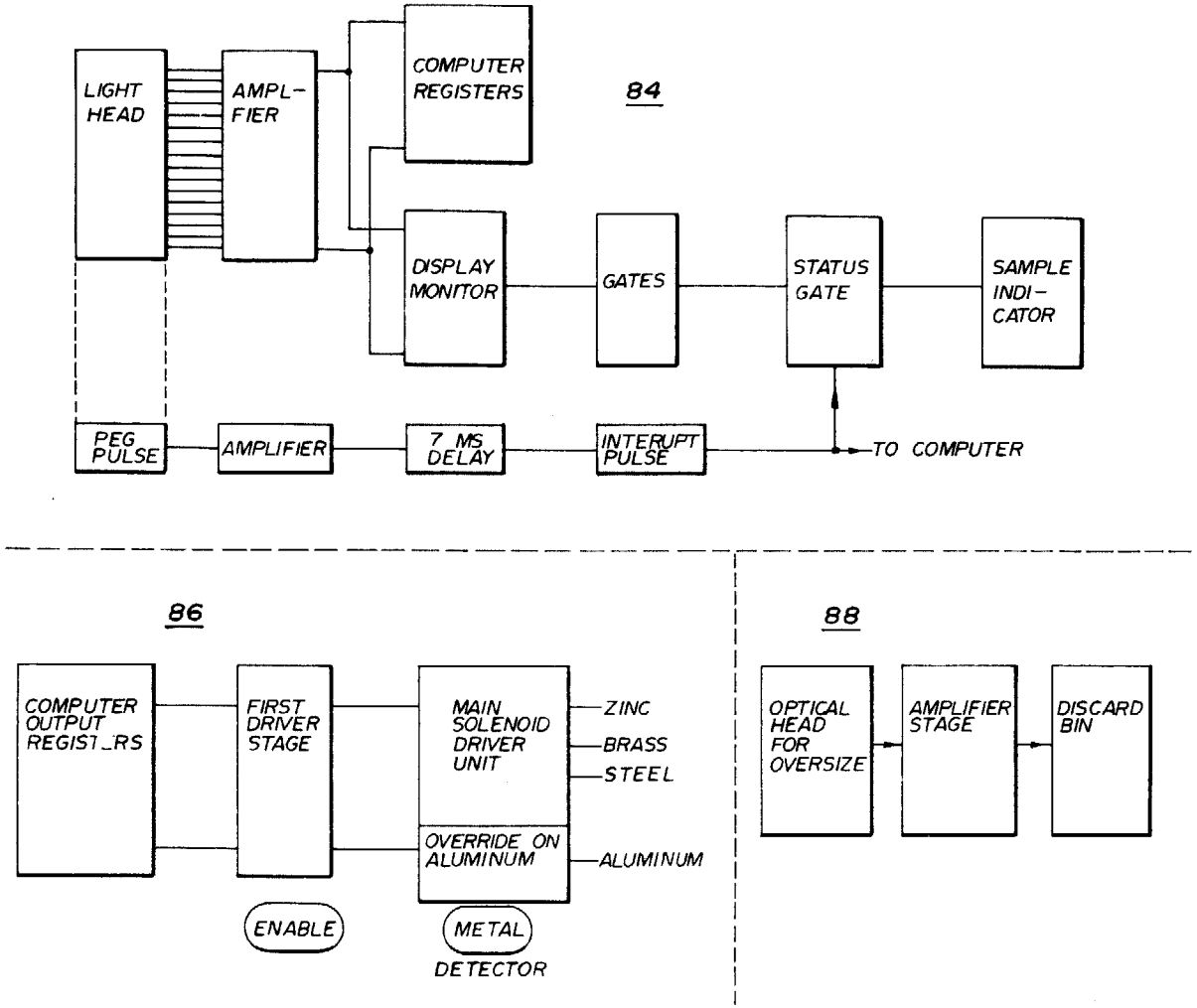
FIG. 7 is a more detailed block schematic diagram of part of the electronic control circuits.

In FIG. 6, there is diagrammatically illustrated, in block form the various units which are incorporated into the apparatus together with their interconnections. The table 24 is associated with the optical detector unit 8 as well as the X-ray detector unit 10. An output from the X-ray detector unit 10 is fed to a pulse process unit 70, (Kevex Corp. model #4532-P), then through an analogue-to-digital converter (ADC) unit 72 (Northern Scientific model #TN1313) to the computer unit 62. Units 70, 72 and 74 are indicated in FIG. 5 as the single unit 60, A teletype unit 76 and a display unit 78 are associated with the computer 62 whilst signals pass between the computer 62 and automation module unit 80. The automation module unit 80 is operational to receive signals from the optical detector unit 8 and pass the information on to the central processor unit for analysis. Control signals pass through the automation module unit 80 to control a relay unit 82 whereby the selected one of the control stations 12 through 22 is provided with information signals to initiate its operation at a time when the respective piece of scrap metal is over the output chute for that particular control station. In FIG. 7, there is diagrammatically illustrated, in block form, part of the electronic stages which are incorporated in the units illustrated in FIG. 6. It is believed that the function and operation of the stages illustrated in FIG. 7 will be clear from the labelling thereof and it will be seen that the stages have been grouped into the respective groups, data input circuits 84, output drive circuits 86 and height reject circuit 83. Thus, the illustrated stages may be considered as the electronics for the light head stage 10 of FIG. 1 and the driver circuits for the solenoid stages such as illustrated in FIG. 4.

Figure 8:
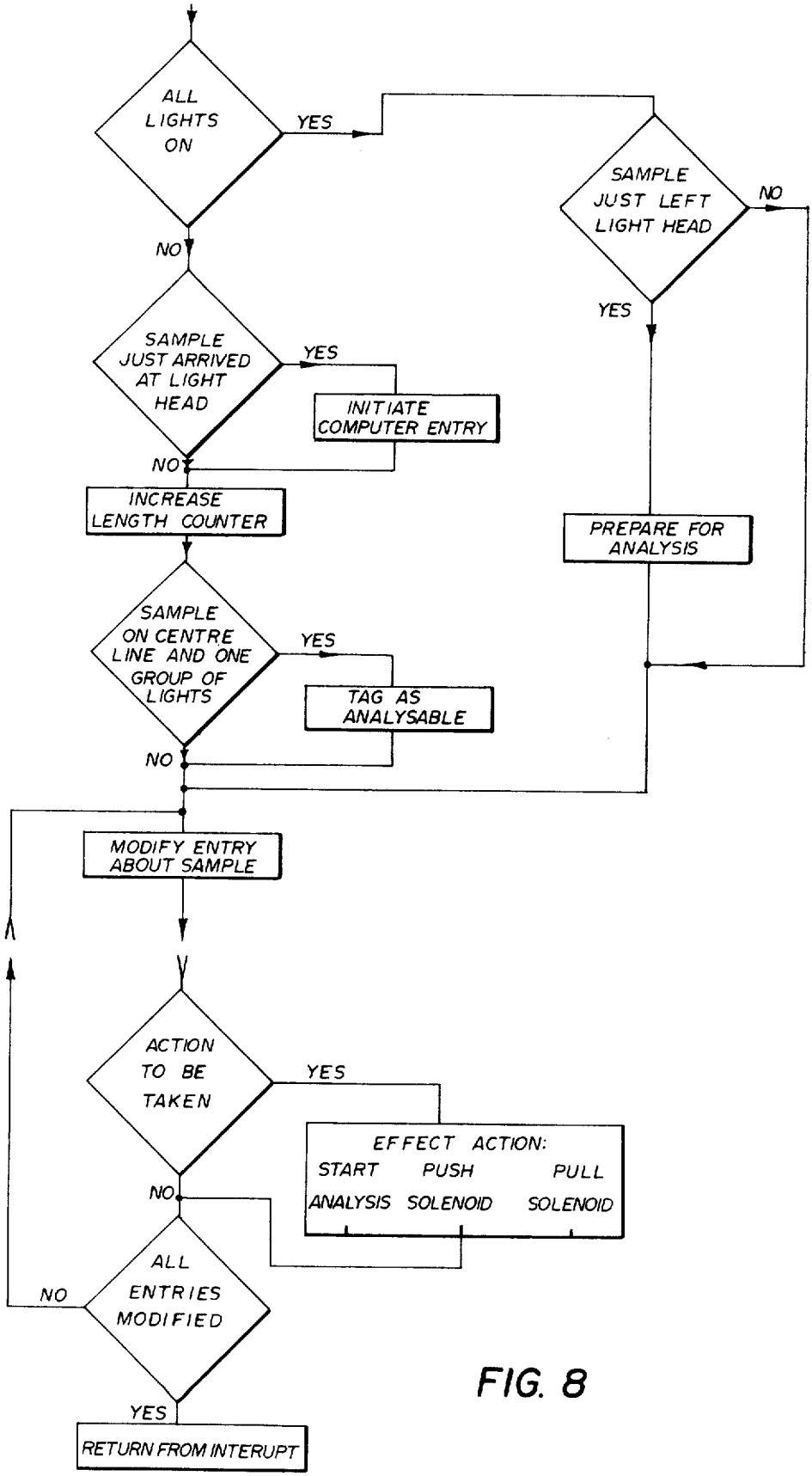
FIG. 8 is a schematic outline of a software program for the apparatus of FIG. 1.

In FIG. 8, there is drawn a schematic outline of the software program when the light head stage 8 (FIG. 1) produces an interrupt operation. The outline is the main decision-making routine in the computer 62 (FIG. 6) which is programmed to control the reaction of the sorting table 24 of FIGS. 1 and 6 and its associated apparatus. The simple program normally running in the computer displays the X-ray spectrum which is accumulating in the computer's memory. When an interrupt occurs as a result of a peg pulse, the display program is broken and the sequence of operations illustrated occurs. The operation of the outline shown in FIG. 8 will be clear to an expert skilled in the art having regard to the labelling used thereon.

Figure 9:
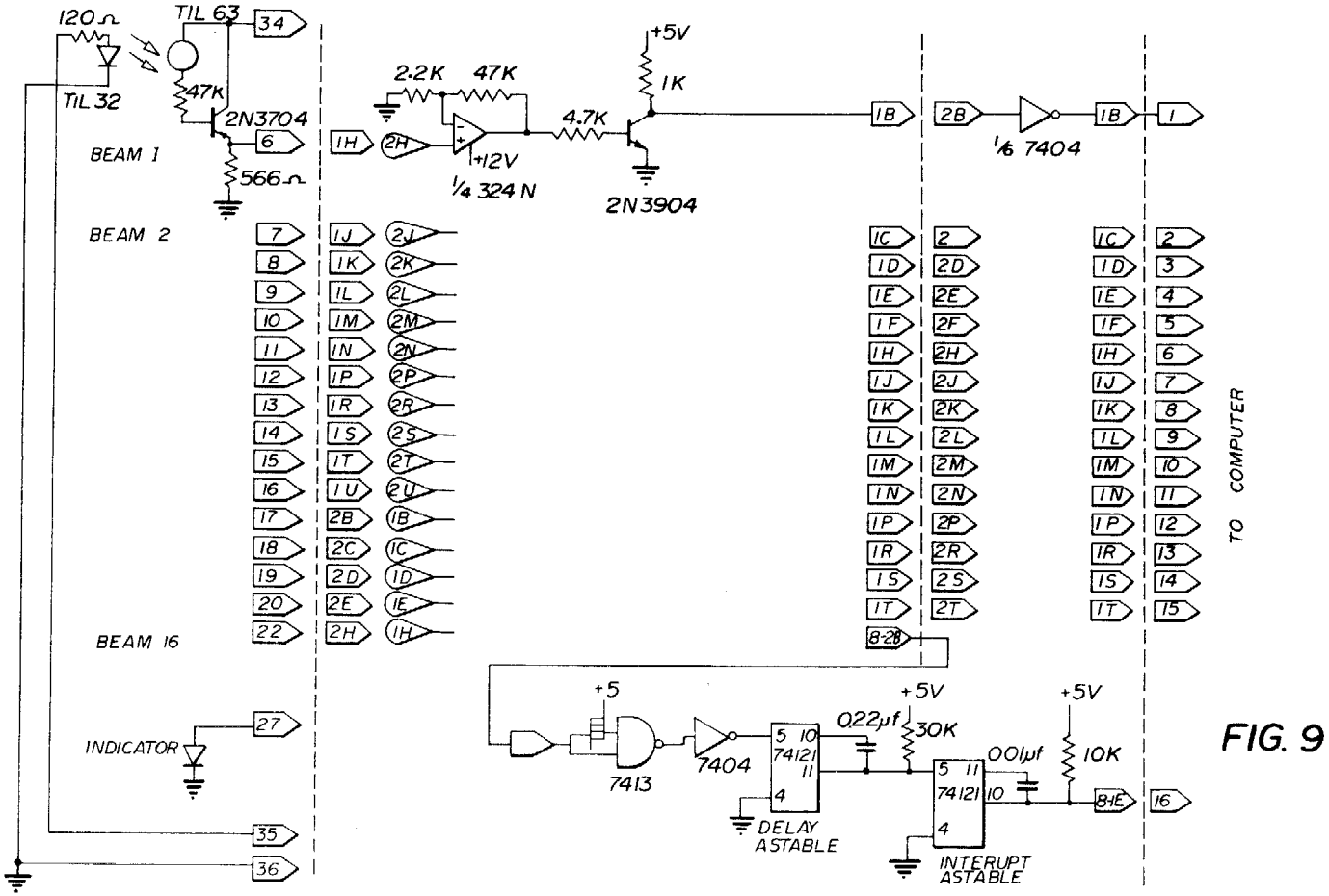
FIG. 9 is a diagrammatic representation of light-emitting diode sources and associated optical detectors in the light head, FIG. 10 diagrammatically illustrates the solenoid driver stages.

In FIG. 9, there is diagrammatically illustrated the light-emitting diode sources and the associated optical detectors in the light head 8 (FIG. 1). The use of diode sources and the optical detectors permits close spacing between the lights beams and this allows objects to be located on the keys with a high degree of accuracy. This is of importance in making decisions as to whether two objects are located side-by side, or deciding whether an object is located in a suitable position so that it will be satisfactorily sorted by the detecting unit 10. The light beams are arranged to be perpendicular to the axis of the conveyor and each light beam is interrupted by the movement of a key under the head. If a beam is interrupted within this space, simple counting of the number of keys which pass under the head whilst such an interruption continues gives the apparatus a measure of the length of the object independently of the speed of the conveyor 4.

As will be appreciated, the movement of the regularly spaced keys through the light beam allows the position of a piece of scrap metal to be determined as it moves with the carousel conveyor. Since each successive pulse which is generated when the beam is broken represents the movement of the conveyor 4 by a distance corresponding to one key spacing, the position of the object on the table can be located by counting pulses from some arbitrary position, the light head. This is completely independent of variations in the speed of the conveyor and it has been demonstrated that no other method of object location need be provided.

With reference to FIG. 9, it will be seen that each detector is incorporated in a transistor emitter-follower circuit. The low impedance output is connected via a multi-conductor cable to an integrated circuit amplifier and sixteen separate outputs are selected. These are fed to the digital computer which evaluates which of the beams in the series of sixteen are occulted at the time that an interrupt pulse is generated.

To produce a pulse as each key passes through the light beams, the light beam closest to the perimeter of the conveyor 4 is emitted, detected and then amplified as described above. As the light beam reappears after the passage of a key, the voltage step in the light detector is fed to an astable multi-vibrator which generates a pulse of a duration approximately equal to one-half that of the time for which the light beam will be on. At the end of this pulse, a second astable multi-vibrator generates a pulse of relatively short duration which is provided to the computer as an interrupt signal. It is during this pulse, that the computer reads the information about which light beams are occulted.

The display monitor circuitry displays the signals presented to the computer on a set of light-emitting diodes. The outputs are also combined through a sequence of gates to activate a light-emitting diode when an object is detected between the keys. The status of this indicator only changes during the computer-read pulse.

Figure 10:
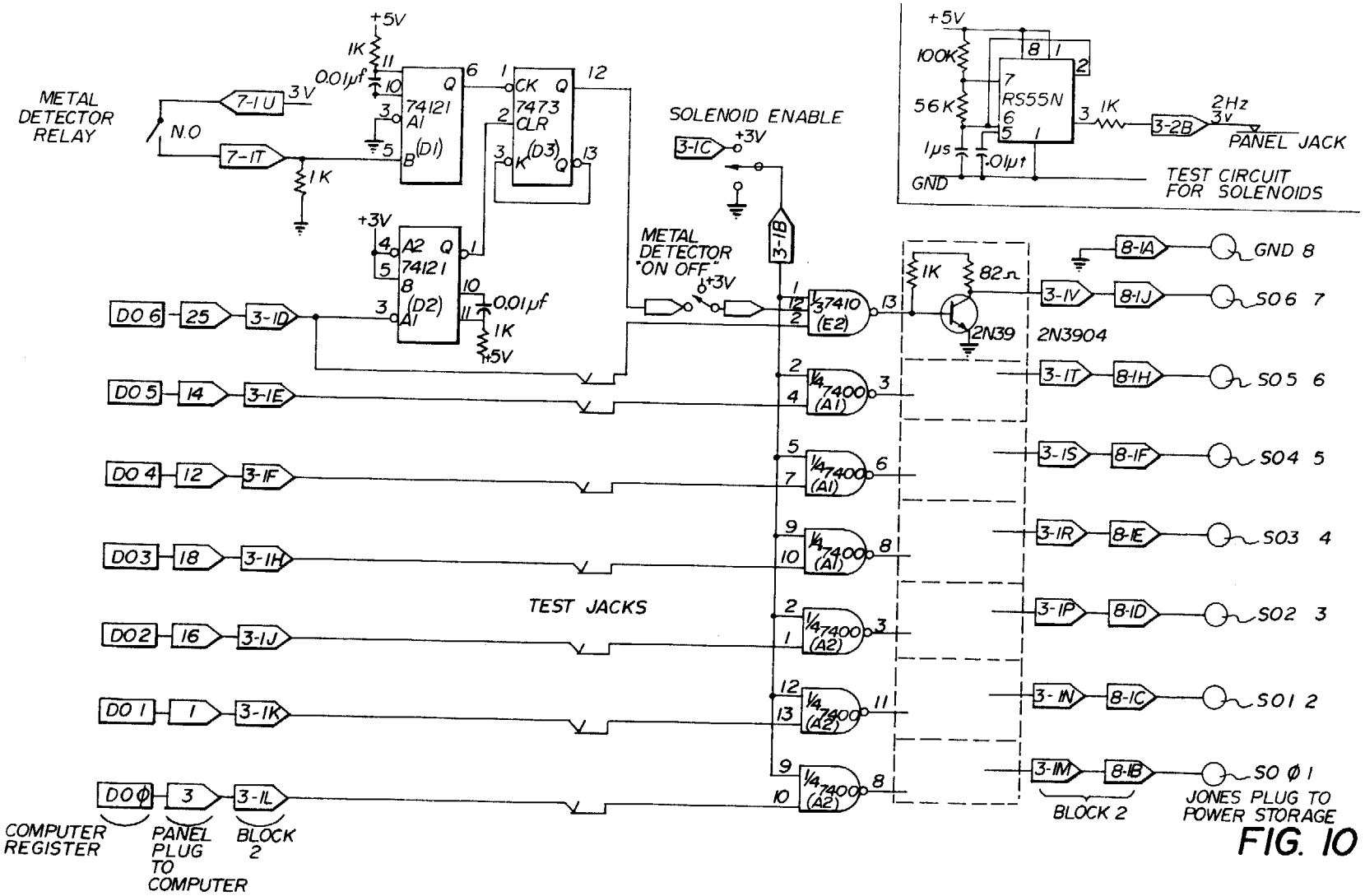
Figure 11:
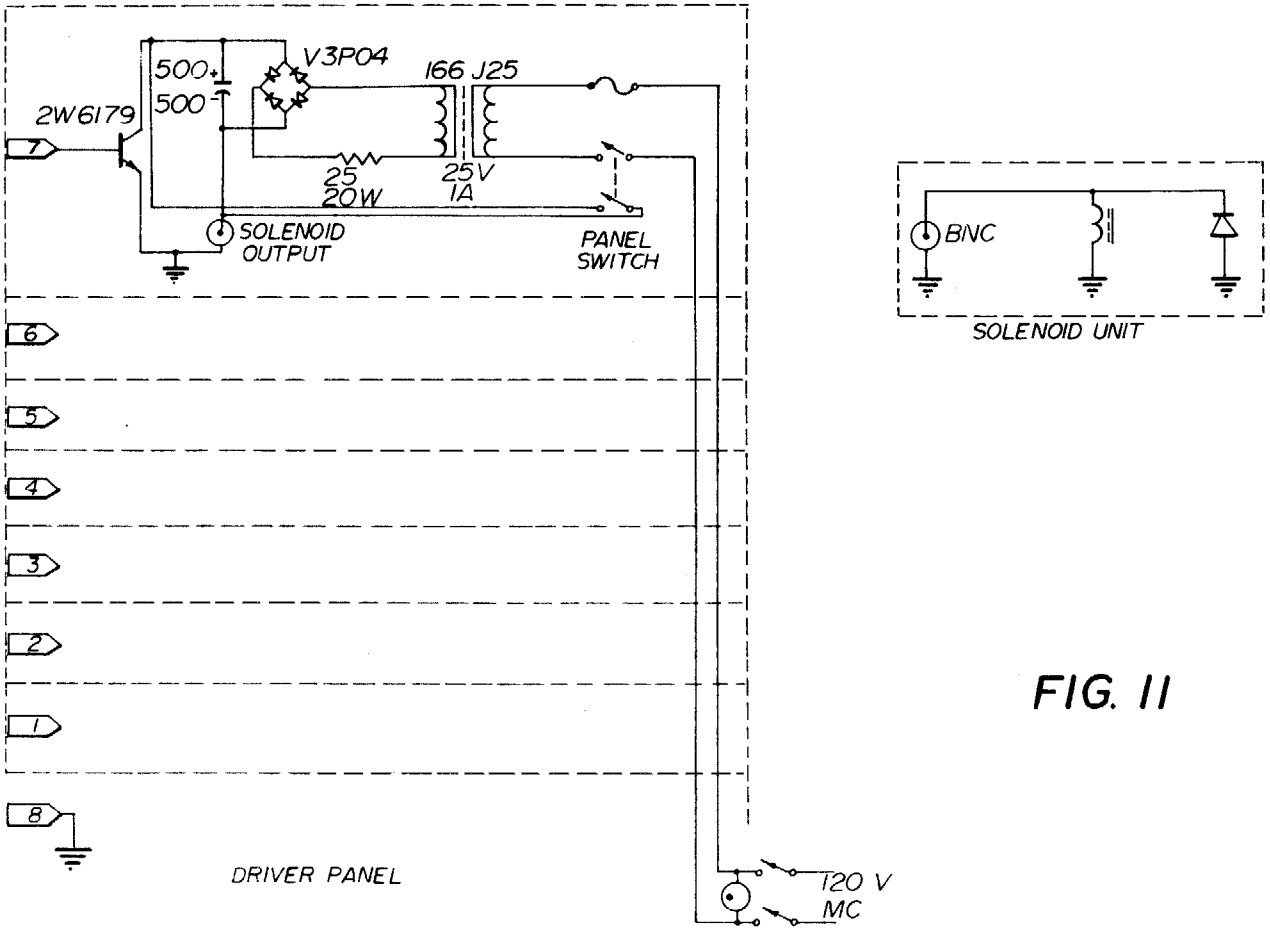
FIG. 11 is a diagrammatic represention of the power circuit for the solenoid stages.

In FIG. 10 there is diagrammatically illustrated the arrangement for the solenoid driver stages, whilst in FIG. 13 the power circuit for the solenoid stages is shown. Signals generated by the computer are arranged to cause a specific solenoid, like 40 (FIG. 4), at a respective control station (FIG. 1) to be activated. These signals are passed by way of a connecting cable to a single stage transistor amplifier (FIG. 11), whose output is connected to a solenoid driver unit. As will be seen in FIG. 11, this comprises a power circuit utilizing an A.C. source, a transformer, a full-wave bridge rectifier circuit and a current limiting resistor. The power supply charges a capacitor which may be connected across the terminals of the solenoid by the imcoming pulse applied to the base of a power transistor used in a searching mode. This arrangement provides a strong initial pulse to activate the solenoid and a weaker holding current appropriate to the permitted power dissipation in the solenoid coil.

The solenoid driving circuit is repeated in accordance with the number of solenoids provided. At one of the control stations, an overide circuit is provided utilizing a commercial metal detecter and a Schmidt trigger circuit to only activate the solenoid if the object is metallic in nature. All other objects are treated as non-metallic and remain on the conveyor unit 4 until a discard outlet is reached.

From the above and with reference to FIG. 5 it will be appreciated that the illustrated circuit design has two functions incorporated within it, as set forth below (a) The provision to the computer of the information which includes:

(i) An interscript signal to denote the movement of a key under the light head unit 10. This pulse forms a peg counter for object location on the conveyer 4, and also is utilized to enable the digital computer to alter information stored in its internal registers.

(ii) A series of voltage levels which are high or low depending on whether any given light beam is interrupted. These levels are transferred to the computer registers only during the above-mentioned interrupt signal.

(b) The provision of a test facility which includes an illuminated display of the status of each light beam and an indicator to show whether any light beam is interrupted by an object. This feature is believed to be useful for routine testing and setting up of the detector with respect to the keys. The front panel lamp display is a set of light-emitting diodes which are not illuminated if a beam is broken. If an object is detected by any beam, the light-emitting diode is lit and a voltage appears at a test point on the front panel.

After the analysis has taken place, the digital computer changes the voltage level within a register appropriate to sorting the metal into a particular bin. This level operates a particular solenoid through the respective output drive circuit.

The X-ray fluorescence unit operates to sort non-metallic materials towards the bin allocated for aluminium. The solenoid driver circuit for this bin is fitted with an over-ride circuit whereby unless a commercial metal detector placed immediately in front of the bin is triggered, the material will not be sorted and will continue to a discard exit.

To prevent excessively high pieces of material from damaging the light head unit 8 or the detector unit 10, a horizontal light beam in unit 7 (FIG. 1) is provided at a set height of approximately three inches above the members 6. This is positioned just after the place where the pieces of scrap metal come off the feeding conveyor. If the light beam is occulted some twenty keys are dropped at a station situated just after this horizontal light beam and similar to those of stations 12 to 22.

Apparatus according to the present embodiment of this invention has been described above. Consideration will now be given to the operation and use of the apparatus having particular regard to the sorting of shredded automobile scrap metal. This is usually non-ferrous but it will be appreciated that this embodiment can equally be applied to ferrous scrap material. Automobile scrap material can usually be classified into the following groups:

(1) Zinc alloys.

(2) (a) Copper and brass. (b) Copper wire with some form of insulation.

(3) Stainless steel.

(4) Aluminum.

Using the X-ray fluorescence unit for sorting mixed scrap materials into the above catagories, it was concluded that sorting rates of up to 1½ tons per hour may be possible with 5% mis-sort or less assuming that the material is properly fed to the conveyor 4.

As mentioned above, soon after a sample arrives on the table from the conveyor belt system, it passes through the linear array of infrared light beams which are set perpendicular to its path and which are arranged vertically so that they can pass between the keys on the rotating wheel. If a sample cover part of the opening between two keys, some of the 16 light beams will be occulted. The position of each light beam occulted is passed to the computer. The electronic units necessary to effect this transfer can be readily determined from the above description and will be seen to consist of an amplifier, a comparator, and a pulse-shaping circuit. As mentioned above, the signal from one light beam, on the rim of the table is sometimes called a "peg" pulse and is specially treated whereby it is delayed approximately seven milliseconds befor being set as a relatively short signal to the computer 62 (FIG. 5). All the signals pass through the I/O interface within the Tracor Northern 1310 interface section within unit 80 and are then fed to the computer. The peg pulse causes what is called an "interrupt" in the computer which then accepts the information from the light head. The computer determines which of the light beams are occulted in each opening between the keys and from this information the computer notes:

(1) where the sample is radially on the keys in order to decide if the sample will pass under the X-ray fluorescence detector, (2) if there is more than one sample side by side on the table in order to cancel the X-ray annalysis and thus prevent mis-sorting, (3) the number of openings between keys in which at least one light beam is occulted in order to determine the length of the sample.

The X-ray fluorescence system was described above with reference to FIG. 5 and it will be understood that when the material is excited by radiation, part of the incident energy is lost by the emission of the X-rays which have energies characteristic of the elements present in the samples. The energy and intensity of such characteristics X-rays serve as a unique signature of a given material.

Radiation from the radioactive source $^{125}I$ is incident on the sample under investigation which then emits characteristic X-rays. These are then detected by a lithium drifted silicon counter unit 58 (FIG. 5). The output identifying signals from this counter consists of a series of voltage pulses of amplitude proportional to X-ray energy. The pulses are amplified and shaped by a standard nuclear electronics stage, and the number of pulses corresponding to a given energy (element) are sorted into a spectrum and displayed using the computer stage 62. Using this spectrum, the minicomputer can make decisions about the type of object presented to the detector and provide command control signals to operate the mechanical sorting equipment.

As will be understood, the computer associates with each object an identification made by the X-ray detector and prepares subsequent components to discharge the respective object at the respective solenoid for the particular type of material. The computer keeps track of the position of the total number of objects (normally up to thirty) as they move around the table by counting the keys as they pass under the optic light head. Besides noting the passage of each key the light head, with the help of the computer, measures the length of the object by noting the number of keys which pass the head whilst one or more of the infrared beams is occulated by the respective object.

As mentioned above, at a number of stations around the outer rim of the sorting table there are provided metal slides which can be withdrawn or inserted by means of a solenoid. Withdrawing the slides allows the keys to rotate about their pinned end to discharge objects off the table at the location of the respective solenoid. The operation of these solenoids is controlled by the computer.

As illustrated in FIG. 3, the movable section can be approximately one inch long and is on the end of the plunger of a solenoid. When the respective section is to be withdrawn, i.e when the first part of a sample to be dropped at this station arrives there, the solenoid is simply energized to withdraw the support. When all the keys supporting the respective sample have dropped through the gap in the supporting surface, the solenoid is released and it springs back. Since the keys are somewhat flexible, no difficulty was experienced in the operation of the table if one of the keys was hit by the returning section of the support surface.

The energizing of the respective solenoid is effected by the above-mentioned computer stage since it monitors were each sample is as it moves around the sorting table.

The computer system which is used in the constructed practical embodiment works on the interrupt basis or in real time. Most of the time, it is simply displaying an X-ray spectrum it has in its memory. Two types of interrupt could occur. One occuring if the ADC has completed digitizing a signal from the X-ray detector and the ADC interface (TN1313) interrupted the central processor in the computer and directly modified a memory location. This is normally referred to as direct memory access (DMA) and involves no program steps in the actual transfer if the interface is initialized to operate this way.

The second interrupt occurred when the signal from the peg pulse arrived at the computer. It initiated a sequence of events. Firstly the interrupt indicated to the computer that a key had passed the light head and therefore every sample on the table had moved further along. The computer produced a corresponding adjustment in the entry of its memory for each sample and caused the appropriate action, e.g. firing a solenoid at the appropriate station or starting an analysis at the X-ray fluorescence detector etc., to occur, If all the light beams were not on, the computer determined which light beams were off and whether more than one group of lights was off. This information together with similar information from the previous gaps between the keys allowed the computer to decide if a single sample was on a path going under the X-ray detector and therefore that an analysis should be effected when the sample reaches the detector.

In FIG. 8 there is actually shown the schematic outline of a software program when the light head produced an interrupt. This was a main decision—making routine in the computer programmed to control action of the sorting table.

As mentioned above, the computer was supplied by Tracor Northern and was used to control all functions involved in the sorting operation. It collected the data from the X-ray fluorescence detector, decided what type of material had passed under the detector, noted the passage of each key under the light head and whether a piece of material was sitting on that key and subsequently activated the appropriate solenoid as the respective object reached it.

As will be clear, the software (FIG. 8) for performing these operations was specially written and consisted of two main parts, the analysis part and the table control part. In the first part, the number of counts in several regions of the X-ray spectrum was determined after the sample object had passed the detector. These regions corresponded to those X-rays which are characteristic of Fe, Ni Cu, Zn and a background. If the largest number of counts occurs in the Fe or Cu regions, then the sample is said to be iron or brass respectively. If the Ni region had the greatest number of counts, then the Cu/Ni and Zn/Ni ratios determined whether the sample was brass or zinc. If the Zn region had the greatest number of counts, then the relative amount of Cu present, i.e. Zn/Cu ratio determined whether the sample was zinc or brass.

If the highest number of counts occured in the background region then the material was aluminum or some non-metallic material. Consequently on the solenoid for aluminum material, a metal detector was provided to check the object for metal content before the solenoid was released.

The second function of the software was to monitor the position of each object as it moved around the sorting table. To do this, information about each sample on the table was sotred in a section of the computer's memory. This information consisted of (1) the position of the sample relative to the light head (2) the length of the sample, in order to drop the correct number of keys, and (3) whether the sample had been analysed and, if so, the type of material so that the sample would be deposited at the appropriate solenoid exit station and exit along a respective selected path.

The digital information from the X-ray detector entered the computer through the TN 1313 interface unit 72 whilst the control information, i.e. the passage of a key or the status of the solenoids, entered through two input-output units in the TN 1310 within unit 80.

The practical system, including the analysis, the computer and sorting table units, were assembled in the form of a commercial unit which was tested and found to besatisfactory. The sample of scrap used was unwashed and had been shredded into pieces to give a more representative weight distribution. The average weight was 44 gms so that a material flow rate of one ton/hr. implied a sorting rate of 20,000/hr. or about 5 per second. Each piece was approximately 2 inches in size and about 60% of the brass and zinc samples were plated. The samples had been hand sorted into commercial categories so as to facilitate the investigation.

Using the X-ray analysis it was found that the materials were well characterized by the elements zinc (Zn), brass (Zn, Cu), wire (with lead in the insulation), stainless steel (Fe, Cr), aluminium (with no characteristic peaks). In the plated samples, only zinc or brass were found to be plated and the plating invariably contained nickel (Ni) and copper (Cu). Since the technique using 125I sampled the surface, nickel constituted the major detected element for both plated zinc and plated brass. However, on the basis of the samples examined, the two materials could be distinguished with greater than 90% certainty by measurement of the Ni: Cu ratio and the Cu:Zn ratio. By producing the results graphically, it was found that plated zinc fell almost exclusively above a particular level whilst plated brass had a higher copper content and fell below the respective level, i.e. line drawn on the graph.

The explanation for this resides in the fact that the nickel acts as a barrier for those X-rays, characteristic of copper or zinc as they return to the detector (FIG. 5). Furthermore, because the characteristic K X-ray of zinc has an energy greater than the binding energy of the K electrons in nickel while the K X-ray of copper does not, the most abundant X-rays from zinc are very strongly absorbed and the discrimination between plated zinc and brass is effected.

It was found that the peaks for all the elements found in the scrap were distinct and their heights could be compared in a simple manner. No problems were encountered due to dirt, and if the sample of scrap examined was representative of the industrial material then no washing would appear to be required.

Experimentally it was estimated that approximately 1000 counts in the whole spectum were required in order to make a clear and reliable recognition of the material. This figure and the time for which a given specimen is in front of the detecting head determines the counting rate required for a given speed of operation.

If scrap material is presented as single pieces separated on 10 cm centres, the conveyor system must travel at 0.5 m/s (1.1 mph) for a material throughput of 1 ton/hr. A rough estimate suggests that if the sample is presented to the detector system for 0.1 sec and 1000 counts are required for a decision, then the counting rate is 10,000/s. Standard nuclear electronics can operate effectively up to 50,000/s so that the principal limitation on counting speed is the strength of the exciting radioactive source.

Sources of a few Curie strength are commercially available and it is to be noted that because the radiation is weakly penetrating, it may be easily confined by simple radiation shields whereby radiocative hazards are minimal.

It will be appreciated that the categories of brass and zinc could be further sub-divided into plated and unplated samples with considerable reliability using the apparatus above. Furthermore, the presence of iron samples as distinct from stainless steel could also be detected.

The embodiments of the invention have been described above in regard to a particular application, i.e. the separation of mixtures of metallic particles. However, it will be appreciated that it can be readily adapted to other uses and for some of these applications X-ray fluorescence may be a suitable method of analysis. The apparatus can obviously be adapted to the separation of alloys of the same class (e.g. the separation of stainless steels, brasses nor nickel alloys). Furthermore, other methods of analysis could readily be employed with the sorting table and the following is a partial list of the measurements which can be made to provide the criteria for separation:

(a) Size and shape
(b) Mass
(c) Radioactivity
(d) Surface features
(e) Temperature
(f) Air resistance
(g) Color
(h) Pre-marking or Tagging.

Appropriate combinations of these measurements may also be employed to determine the separation critera.

The sorting table itself may, also be employed for a varity of other purposes. It is envisaged that it could be modified in the following ways:

(a) Size: The keys can be made of any desired length, width and shape to accomodate items of appropraite shape and size.

(b) Configuration: The keys can be incorporated into a table of circular design, a linear conveying system or may be stacked.

(c) Materials of Construction: The sorting system can be constructed in a varity of materials to suit the particular operating conditions which might, on occasion, involve the immersion of the system in a special atmosphere or liquid.

It will be appreciated that the computer may readily incorporate microprocessors or other microcircuit devices.

(d) Key design: For special purposes the mechanism for key support, release and spacing may be redesigned.

(e) Light Head: The components incorporated within the light head may readily be changed for use in other applications as may the number of light beams. In the present embodiment of the invention sixteen beams were used to facilitate the transfer of information from the light head to the sixteen bit computer.

It will also be appreciated that the sorting mechanism can readily be emloyed as a feeding system for particles or manufactured parts.

While the present invention has been particularly set forth in terms of specific embodiments thereof, it would be understood in view of the present disclosure, that numerous variations are now enabled to those skilled in the art, which variations yet reside within the scope of the present invention. Accordingly, the invention is to be broadly construed and limited only be the scope and spirit of the claims now appended hereto.

It will be readily apparent to a person skilled in the art that a number of variations and modifications can be made without departing from the true spirit of the invention which will now be pointed out in the appended claims.

What is claimed is:

1. Conveyor apparatus for sorting articles including:

(a) a conveyor constructed of key members extending transversely thereacross with a gap between each pair of members (b) feeding means to feed the articles on to said conveyor, (c) detector means located adjacent said conveyor to examine each article to determine at least one characteristic thereof and provide a corresponding identifying signal, (d) means to determine the length of each article as determined by the plurality of key members supporting it, (e) a reference unit positioned at a fixed location in relation to the conveyor whereby the position of each article travelling along the conveyor can be measured therefrom as a function of the number of key members from the article to said reference unit, and (f) control means for utilizing each respective corresponding identifying signal to select one of a plurality of paths and move a respective said plurality of key members from a supporting to a non-supporting position whereby each article is fed along a selected path in dependence on said at least one characteristic of the respective article.

2. Conveyor apparatus according to claim 1 including a respective selected exit station associated with each said selected path and in which said detector means includes examining means to examine each article to determine at which selected exit station it should exit, said control means being responsive to said examining means to cause those keys supporting a respective article to be moved to a non-supporting position at the respective said selected exit station, the operation taking place independently of the speed of the conveyor.

3. Conveyor apparatus according to claim 1 wherein said keys are each pivotally mounted at one end and are substantially horizontal in said supporting position, said keys being caused to rotate downwardly in said non-supporting position at a respective exit station corresponding to a said selected path.

4. Conveyor apparatus according to claim 3 wherein the opposite end of each key is supported on a supporting member as the respective key travels in the direction of the conveyor, at each said exit station a portion of said supporting member being capable of retraction whereby the said opposite ends of selected keys are no longer supported and the selected keys rotate to said non-supporting position.

5. Conveyor apparatus according to claim 1 wherein said conveyor is a horizontal conveyor, said supporting position is horizontal, and said non-supporting position is substantially vertical.

6. Conveyor apparatus according to claim 5 wherein said keys are each pivotally mounted at one end and are substantially horizontal in said supporting position, said keys being caused to rotate by gravity downwardly in said vertical position at a respective exit station corresponding to a said selected path.

7. Conveyor apparatus for sorting metal articles dependent on the type of metal therein including (a) a conveyor constructed of key members extending transversely thereacross with a gap between each pair of members, (b) feeding means to feed the metal articles on to said conveyor, (c) detector means located adjacent said conveyor to examine said metal articles and determine the type of metal therein and to provide a corresponding identifying signal, (d) means to determine the length of each metal article as determined by the plurality of key members supporting it, (e) a reference unit positioned at a fixed location in relation to the conveyor whereby the position of each metal article travelling along the conveyor can be measured therefrom as a function of the number of key members from the metal article to said unit, (f) control means for utilizing each respective corresponding identifying signal to select one of a plurality of paths and move a respective said plurality of key members from a supporting to a non-supporting position whereby each metal article is fed along a selected path in dependence on the type of metal determined therein by said detector means.

8. Apparatus according to claim 7 wherein the metal articles are caused to leave the conveyor at different exit stations in the respective paths, said plurality of key members supporting a respective metal article being capable of movement from a supporting position to a non-supporting position at a selected exit station, said control station selecting the keys for said movement corresponding to the respective path and in dependence on the type of metal determined in the respective metal article by said detector means.

9. Apparatus according to claim 7, wherein said reference unit is a light head capable of monitoring the passage of each member as it travels along the direction of the conveyor.

10. Apparatus according to claim 7 wherein said reference unit comprises a plurality of light sources spaced from each other transversely across the conveyor to provide a plurality of parallel light beams and a corresponding plurality of photocell devices on the opposite side of the conveyor to facilitate pattern recognition of said articles.

11. Apparatus according to claim 7 wherein said reference unit is connected to a computer unit to feed signals thereto each time a member travels past said reference unit, said computer unit counting said signals to determine when a particular article arrives at a predetermined location.

12. Apparatus according to claim 11 wherein when a particular article is located on the conveyor the computer unit determines the number of members over which it extends in the direction of the conveyor.

13. Apparatus accordingg to claim 11 wherein a first predetermined location and a second predetermined location are provided, an analyzing unit being provided at said first location and said second location being a discharge location.

14. Apparatus according to claim 13 wherein when a particular article is located on the conveyor the computer unit determines the number of members over which it extends in the direction of the conveyor, including a plurality of discharge locations, said computer unit operating when the respective article arrives at a respective discharge location to cause said number of members to be moved to a non-supporting position whereby the respective object exits at said respective discharge location.

15. Apparatus according to claim 7 wherein said detector means is an X-ray fluorescence detector.

16. Apparatus according to claim 15 wherein the metal articles are caused to leave the conveyor at different exit stations in the respective paths, said conveyor having a plurality of keys extending transversely across the conveyor and each capable of movement from a supporting position to a non-supporting position at a selected exit station, said control station selecting the keys for said movement corresponding to the respective path and in dependence on the type of metal determined in the respective metal article by said detector means.

17. Apparatus according to claim 8 or 16 wherein the opposite end of each key is supported on a supporting member as the respective key travels in the direction of the conveyor, at each said exit station a portion of said supporting member being capable of retraction whereby the said opposite ends of selected keys are no longer supported and the selected keys rotate to said non-supporting position.

18. A method of sorting metal articles dependent on the type of metal therein including the steps of (a) feeding the metal articles on to a conveyor constructed of keys members extending transversely thereacross with a gap between each pair of members, (b) determining the length of each metal article in dependence on the plurality of keys supporting it, (c) positioning a reference unit at a fixed location in relation to the conveyor and measuring the position of each metal article therefrom as a function of the number of keys from the metal article to said reference unit, (d) radiating each metal article with radiation from a radioactive source whereby it emits characteristic X-rays dependent on the type of metal therein, (e) detecting said characteristic X-rays and producing a corresponding identifying signal corresponding to said type of metal, (f) utilizing each corresponding identifying signal in control means to select one of a plurality of paths to feed each metal article along a selected path in dependence on the type of metal determined therein.

19. A method according to claim 18 including the further steps of (a) providing a different exit station in each respective path of a number of said paths, (b) providing said conveyor with a plurality of keys extending transversely across the conveyor and each capable of movement from a supporting position to a non-supporting position at a selected exit station, (c) causing said control means to select the keys for said movement corresponding to the respective path and in dependence on the type of metal determined in the respective metal article.

* * * * *